United States Patent [19]

Cronin

[11] 4,427,492

[45] Jan. 24, 1984

[54] EXTENDED NIP SHOE FOR A NIP IN A PAPERMAKING MACHINE

[75] Inventor: Dennis C. Cronin, Rockton, Ill.

[73] Assignee: Beloit Corporation, Beloit, Wis.

[21] Appl. No.: 365,858

[22] Filed: Apr. 5, 1982

Related U.S. Application Data

[62] Division of Ser. No. 267,397, May 26, 1981.

[51] Int. Cl.[3] ..... D21F 3/06; D21F 3/08

[52] U.S. Cl. ..... 162/358; 162/361; 100/153

[58] Field of Search ..... 162/358, 361, 205, 305, 162/360, 312, 314; 100/153, 154

[56] References Cited

U.S. PATENT DOCUMENTS 3,011,545 12/1961 Welsh et al. ..... 162/361
3,783,097 1/1974 Justus ..... 162/358
3,808,092 4/1974 Brusker ..... 162/205
4,287,021 9/1981 Justus et al. ..... 162/358
4,308,096 12/1981 Cronin ..... 162/360

FOREIGN PATENT DOCUMENTS 79919 11/1971 German Democratic Rep. .

*Primary Examiner*—Steve Alvo
*Attorney, Agent, or Firm*—Dirk J. Veneman; Kenneth J. Cooper; Michael L. Gill

[57] ABSTRACT

An extended nip shoe for a press section in a papermaking machine distributes a compressive force to an inrunning compliant transport system advancing a web of paper. The shoe introduces and maintains a film of lubricant throughout the extended nip shoe-compliant transport system interface. Similarly, release of the compressive force is gradual to eliminate points of high unit loads on the compliant transport system and paper web.

6 Claims, 7 Drawing Figures

EXTENDED NIP SHOE FOR A NIP IN A PAPERMAKING MACHINE

This is a division of application Ser. No. 267,397, filed May 26, 1981.

BACKGROUND OF THE INVENTION

1. Field of the Invention

This invention relates to a press section of a papermaking machine and to a pressure shoe for use in a press section having an extended nip.

2. History of the Prior Art

The concept of a stationary shoe exerting pressure on a rotating drum through a moving paper web transport system produced questions of friction, temperature, tension, and materials. These questions become evident when the transport systems developed a performance inhibiting bulge at the nip. In earlier patents entitled, "Extended Nip Press with Special Belt Reinforcement," U.S. Pat. No. 4,229,253, issued to the Applicant on Oct. 21, 1980 and "Extended Nip Press with Bias Ply Reinforced Belt," U.S. Pat. No. 4,229,254, issued to Michael L. Gill on Oct. 21, 1980, transport belt designs were proposed as answers to some of these questions. A reinforced belt was found to bulge less at the extended nip. As a result, the belt tension, machine part wear, and energy consumption could be reduced. Nevertheless, further reduction in power consumption, frictional forces, and pressure concentrations at the nips of the papermaking machine were still needed.

D. D. Fuller, in his text entitled, *Theory and Practice of Lubrication for Engineers*, published in 1956, studied the friction and pressure buildups on the surface of variously designed hydrodynamic bearings. His studies indicated the design of the inlet geometry for hydrodynamic bearings had little effect on the frictional forces or pressure buildups at the bearing surface. As a result, prior art in the area of extended nip applications in papermaking machinery indicated little need for specialized nip shoe design.

When Fuller's conclusions were tested, it was unexpectedly discovered that nip shoe design is significantly relevant when compliant or compressible materials are subjected to the hydrodynamic bearings. It was found that the compliant transport systems used in paper making operations exhibit properties which are appreciably different from the non-compliant surfaces tested by Fuller.

Fuller discussed the friction, pressure, and lubrication considerations associated with shafts, metal sliding surfaces on production machine tools, and the interfaces of other metallic components. Such applications required no special hydrodynamic bearing design to maintain an adequate film of lubrication along the interface of contacting metal parts. However, the bearing design was found to have a substantial impact when used with the compliant felts and transport belts common in papermaking machinery.

Data indicated that the compliant transport systems, used to move a paper web through a papermaking machine, "bunched up" at inrunning nips and caused excessive friction, pressure, and power consumption throughout the papermaking machine. A film of lubricant at the interface of a nip shoe and compliant transport system was consistently wiped away by the friction and pressure concentrations at the inrunning nip.

Faced with dilemna, the extended nip shoe design was modified and eventually a shoe which significantly reduced friction and pressure at the inrunning nip was developed. The novel extended nip shoe design also maintained a film of lubricant at the interface of the compliant transport system and the extended nip shoe. It was concluded that by extending the nip shoe beyond the point where the compliant transport system initially compacts against the shoe and opposing surface, lubricant could be introduced into, and maintained throughout, the shoe-compliant transport system interface.

The disclosed extended nip shoe design decreases the pressures at the inrunning and outrunning nips. A lubricating film at the shoe-compliant transport system interface decreases the frictional forces along that interface. Since the impediments of friction and pressure concentration are decreased, the power required to move the compliant transport system across the extended nip shoe is also reduced. By-products of the decreased friction, pressure, and power consumption include lower operating costs and extended bearing and compliant transport system lives since less tension is required to move the transport system over the shoe. The invention permits increased control of paper web processing time under selected pressures. The extendability of the nip allows lower pressure application to a web of paper over longer time periods. The web processing operation is extended from the previous line of contact between two press rolls to the longer contact time available with the extended nip. This feature may produce a higher quality of processed paper than previously realized under short time but high pressure paper processing.

SUMMARY OF THE INVENTION

An extended nip shoe for a press section in a papermaking machine compresses a web of paper riding on a compliant transport system along a portion of the press section. This pressure application aids the removal of moisture from the paper.

The extended nip shoe has an apparatus for applying a lubricant to the compliant transport system to decrease the frictional forces between the shoe surface and the compliant transport system. The inrunning nip surface of the shoe is inclined or ramped to gradually apply the compressive force exerted by the shoe onto the compliant transport system. The inclined surface presents a throat leading into the inrunning nip. The throat funnels the lubricant to the compliant transport system-shoe interface in a manner which effectively maintains a layer of lubricant along the entire interface.

The outrunning nip surface is inclined or ramped to gradually release the compressive forces on the compliant transport system. High pressure differences on the proposed web of paper are thereby reduced to improve paper quality. The side edges of the shoe also offer pressure relief by sloping or ramping away from the axis of rotation of the press roll. This shoe geometry directs excess lubricant away from the compliant transport system and the web of paper into a lubricant reservoir for subsequent recirculation and application to the transport system at the inrunning nip of the shoe.

The invention may be used with hydrodynamic and hydrostatic bearings to relieve the frictional forces and pressure differences along the inrunning, outrunning, and side edges of the bearings.

DETAILED DESCRIPTION

Figure 1:
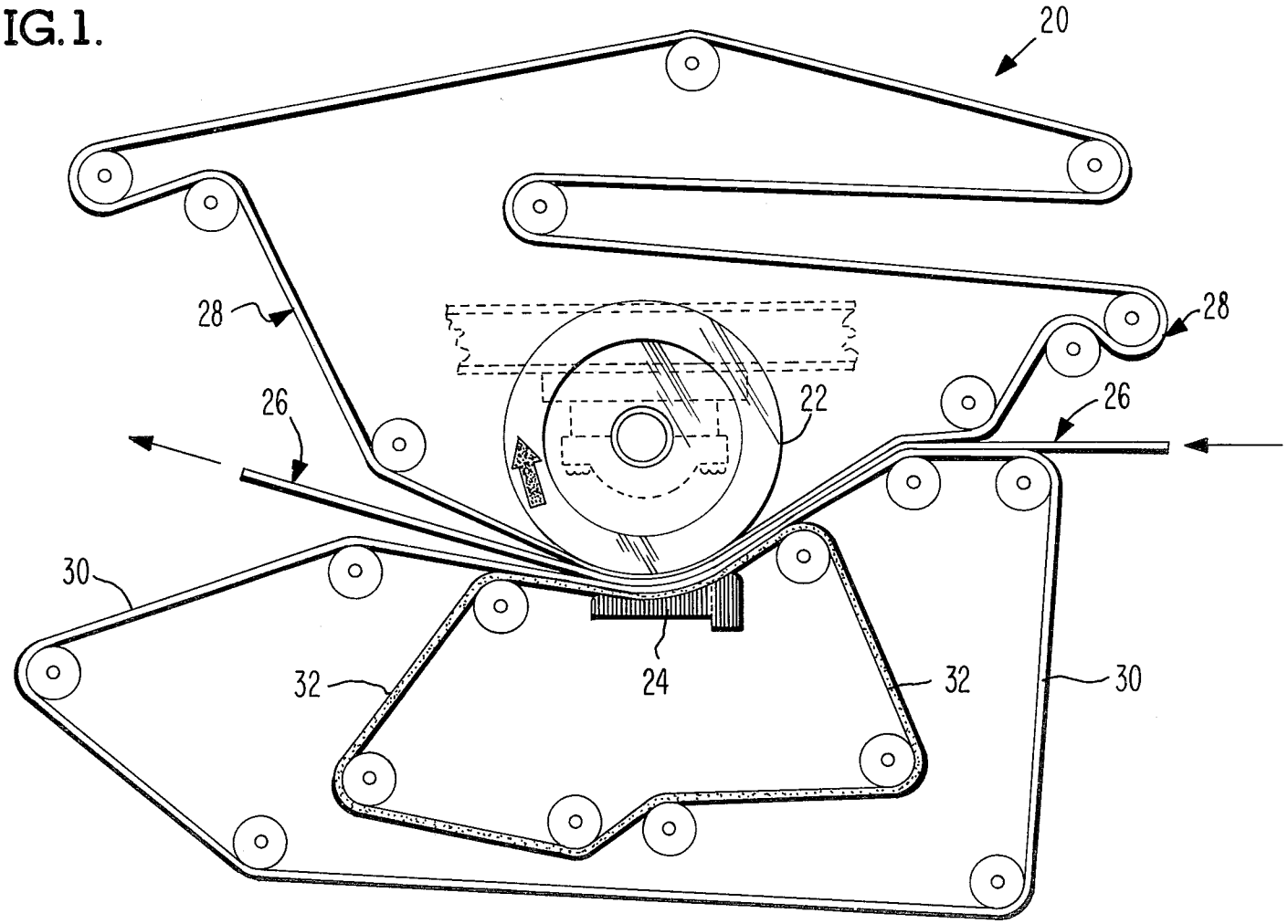
FIG. 1 shows a side schematic view of the compliant transport system for transporting a web of paper through the shoe-press roll interface.

A press section 20 in a papermaking machine is depicted in FIG. 1. The purpose of this section is to remove moisture from a web of paper which is being formed. This moisture removal occurs along the interface of a press roll 22 and a nip shoe 24. The web of paper 26 is transported to this interface between an upper felt 28 and a lower felt 30. These felts form continuous loops through the press roll-nip shoe interface.

The felts and web of paper are transported through the press roll-nip shoe interface by a compliant belt 32. This compliant belt is made of a lubricant impermeable material to shield the felts and web of paper from lubricant applied to the compliant belt 32 to decrease friction along the belt-shoe interface.

The web of paper is transported through the press roll-nip shoe interface to primarily remove moisture from the paper web. In addition, the pressure applied by the nip shoe 24 to the web of paper 26 may be used to impress a smooth finish on the paper, remove lumps from stock used in forming the paper, and compress the web of paper to a desired thickness. It was further contemplated that such operations may be performable by constructing an interface between two nip shoes. Such an interface could be extended to a predetermined length to permit paper processing under lower pressures for longer periods of time. Such an arrangement could produce substantial savings due to reduced component wear and energy requirements.

Figure 2:
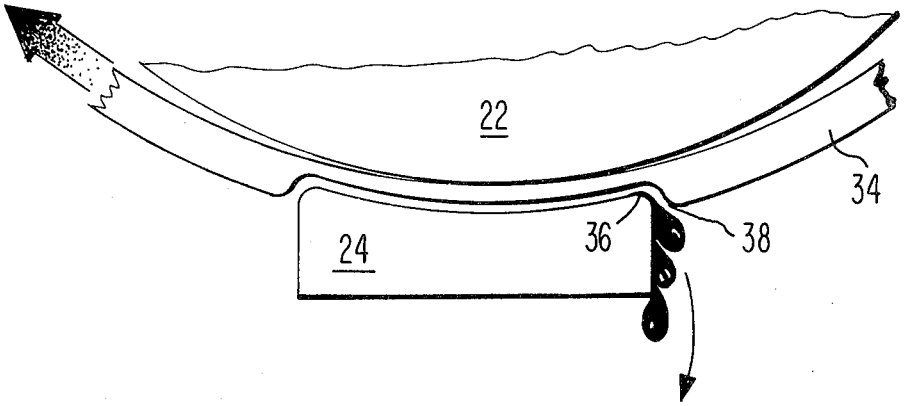
FIG. 2. Prior Art
FIG. 2 is a schematic side view of the shoe-press section interface depicting lubricant being wiped from a shoe not having the extended nip of the invention.

It was found that existing nip shoe designs were inadequate for use with the compliant transport systems common to papermaking machines. These compliant transport systems 34 (FIG. 2), composed of felts and a compliant belt, bulged at the inrunning nip when compressed by the nip shoe 24 against the press roll 22. The bulge impinged upon the inrunning nip surface 36 and wiped off the lubricant intended to decrease the friction between the compliant transport system 34 and the nip shoe 24. The radical compression of the compliant transport system 34 produced high pressure concentrations at the inrunning nip surface 36. Consequently, frictional forces and temperatures were high along the compliant transport system-nip shoe interface. These conditions required more energy to be consumed in moving the compliant transport system. Bearing and material lives decreased because more tension was required on the compliant transport system to remove the undesirable bulge at the inrunning nip. Consequently, the existing shoe design would involve frequency parts replacement, corresponding lost production, and inevitable paper quality deterioration during the marginal operation of a worn compliant transport system.

The invention offers a solution to the above described problems. One objective of the invention was to gradually distribute and apply pressure from the nip shoe 34 (FIG. 3) to the web of paper 26 against a press roll 22. This gradual pressure application would eliminate the problem causing bulge in the compliant belt 32, lower felt 30, and upper felt 28. A second objective of the invention was to maintain a film of lubricant along the interface of the nip shoe 24 and compliant belt 32 to decrease the frictional forces and associated high temperatures.

The extended nip shoe 24 (FIG. 3) performs as a hydrodynamic bearing. A web of paper 26 may be sandwiched between an upper felt 28 and a lower felt 30. In the alternative, paper processing may occur in the absence of an upper felt 28.

Figure 3:
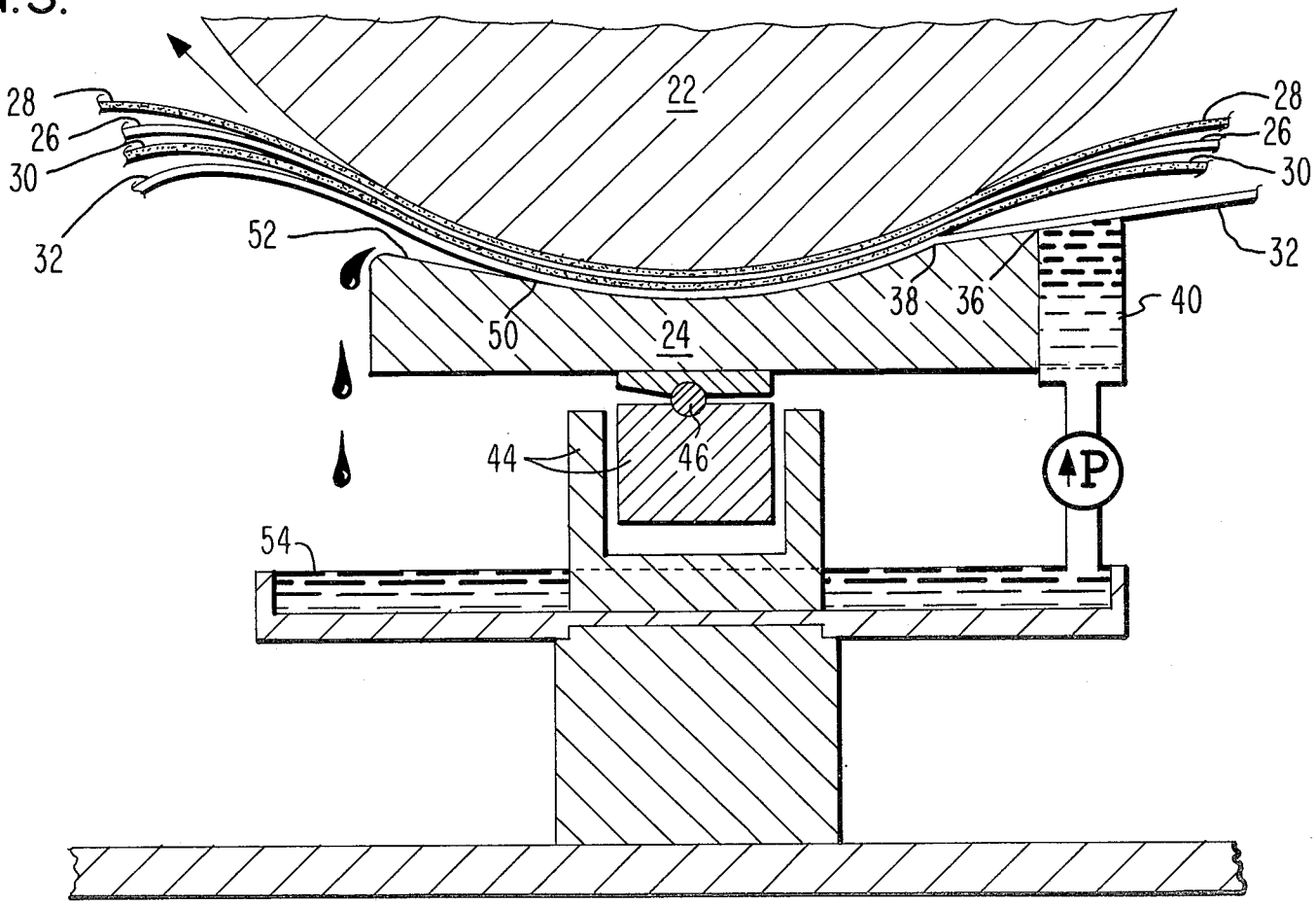
FIG. 3 is a sectional side view of the extended nip shoe in its operating environment.

A compliant belt 32 contacts lower felt 30 prior to reaching the inrunning nip point 38 formed between the nip shoe 24 and press roll 22. Prior to contacting lower felt 30, compliant belt 32 is lubricated for its passage along the shoe-press roll interface by passing over lubricant reservoir 40. The lubricant is maintained at a level sufficiently high to contact the transport belt 32 as it moves toward nip shoe 24. Flexible side panels 42 (FIG. 4) on reservoir 40 prevent lubricant spillover during lubricant contact with the compliant belt 32 (FIG. 3).

Figure 5:
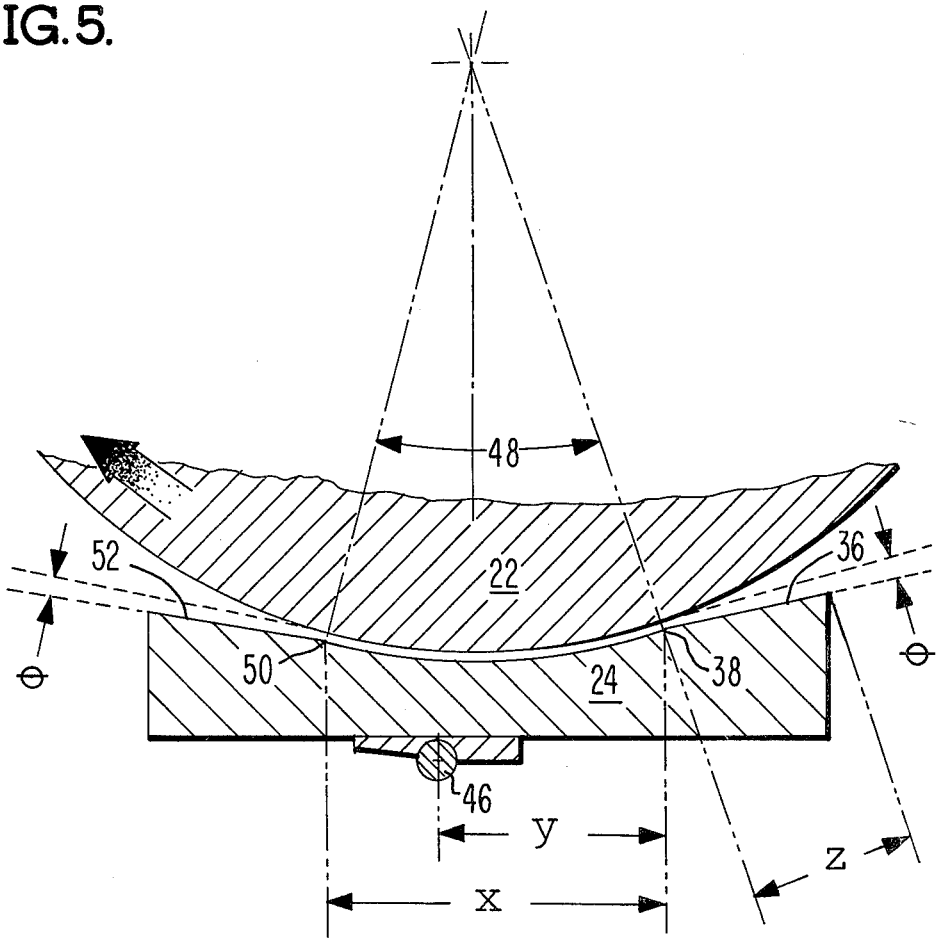
FIG. 5 represents the load arc of the extended nip shoe on a press roll of a papermaking machine.

The inrunning nip surface 36 extends from inrunning nip point 38 approximately 2–4 inches (denoted as Z in FIG. 5). Nip shoe 24 (FIG. 3) is advanced toward press roll 22 by a piston cylinder combination 44. The force applied by the combination 44 is transmitted to nip shoe 24 through pivot 46.

When nip shoe 24 exerts pressure against press roll 22, the area under this force forms a load arc 48 (FIG. 5). This load arc extends from the inrunning nip point 38 to the outrunning nip point 50.

Pivot 46 is positioned along nip shoe 24 so the distance from inrunning nip point 38 to pivot 46 (denoted by y) divided by the distance between inrunning nip point 38 and outrunning nip point 50 (denoted by x) yields a quotient of between 0.6 and 0.8. In contrast, hydrodynamic bearings used with noncompliant materials locate the pivot for the bearing at a position where $y/x$=approximately 0.58.

The extended inrunning nip surface 36 gradually applies the force exerted by the shoe 24 to compliant belt 32 (FIG. 3). This gradual force application is accomplished by inclining inrunning nip surface 36 (FIG. 5) approximately 1.5° (denoted by the symbol $\theta$) from a line substantially tangent to the load arc 48 of nip shoe 24 through inrunning nip point 38. By inclining the inrunning nip surface 36 as described, a ramp is provided which is essentially free of abrupt changes. The smooth transition of the compliant belt 32 (FIG. 3), lower felt 30, paper web 26, and upper felt 28 from an uncompressed to a compressed state allows a film of lubricant to remain on the compliant belt 32 throughout the nip shoe 24-compliant belt 32 interface.

Prior to the application of pressure by the nip shoe 24, felts 28 and 30 have a thickness of approximately 0.120" while compliant belt 32 is approximately 0.3" thick. The full force of nip shoe 24 fully compresses compliant belt 32 and felts 28 and 30 at inrunning nip point 38. In the full compressed state, felts 28 and 30 have thicknesses of approximately 0.07" while compliant belt 32 compresses to 0.290". Such compressions indicate that significant thickness changes occur in the felts. As a result, tests have indicated that the greater the change in thickness, the more inrunning nip surface 36 must be extended beyond inrunning nip point 38. A two-four inch inrunning nip surface 36 has been adequate for uncompressed felt thicknesses of 0.120" and compliant belt 32 thicknesses of 0.3".

Outrunning nip surface 52 (FIG. 3) has a twofold function. First, the outrunning nip surface 52 channels lubricant from the nip shoe-compliant belt interface to a catch pan 54 under nip shoe 24. This lubricant is recirculated to reservoir 40 by pump 56. The second function of outrunning nip surface 52 is to gradually release the compressive force of nip shoe 24 from compliant belt 32, felts 28 and 30, and paper web 26. The length of outrunning nip surface 52 is not as critical as the length for inrunning nip surface 36. However, outrunning nip surface 52 must also be inclned approximately 1.5° (denoted by $\theta$ in FIG. 5) from a line substantially tangent to load arc 48 through outrunning nip point 50. This inclination allows the compressive force exerted by nip shoe 24 to be gradually removed.

Figure 4:
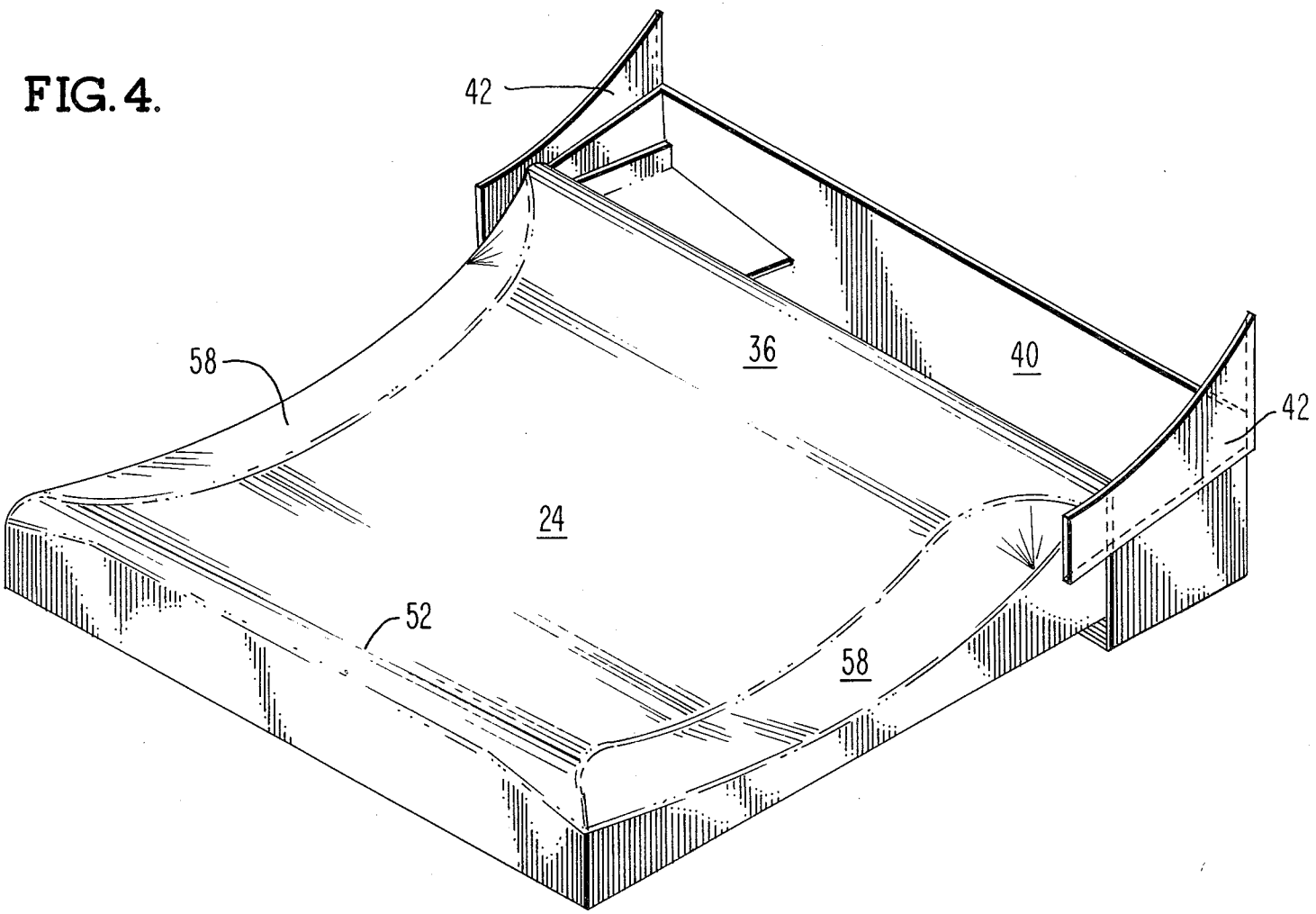
FIG. 4 illustrates the extended nip shoe.

Referring to FIG. 4, side edges 58 of nip shoe 24 are inclined away from the axis of rotation of press roll 22 (FIG. 3). Compliant belt 32 distorts sideways during the movement along the nip shoe-compliant belt interface. This sideways distortion brings compliant belt 32 to the side edges 58 (FIG. 4) of nip shoe 24. Side edge inclination gradually relieves pressure concentrations on compliant belt 32 (FIG. 3) to avoid adverse crimping, stress, or other quality related considerations in paper processing. In addition, the side edges 58 (FIG. 4) direct excess lubrication away from the compliant belt 32 (FIG. 3) and lower felt 30 to avoid contamination of paper web 26 by lubricant.

Figure 6:
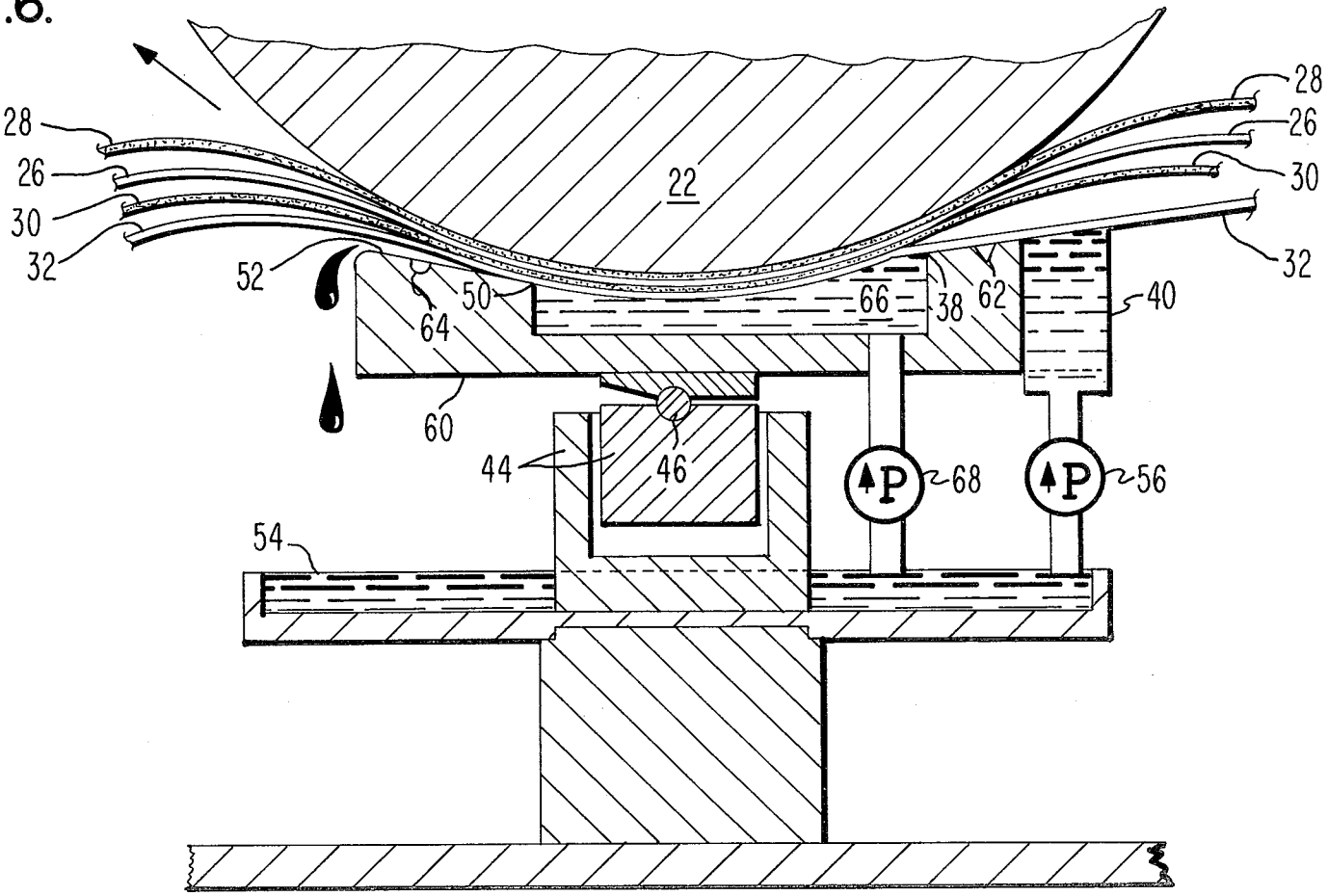
FIG. 6 is a sectional side view of a hydrostatic shoe having the extended nip of the invention.
Figure 7:
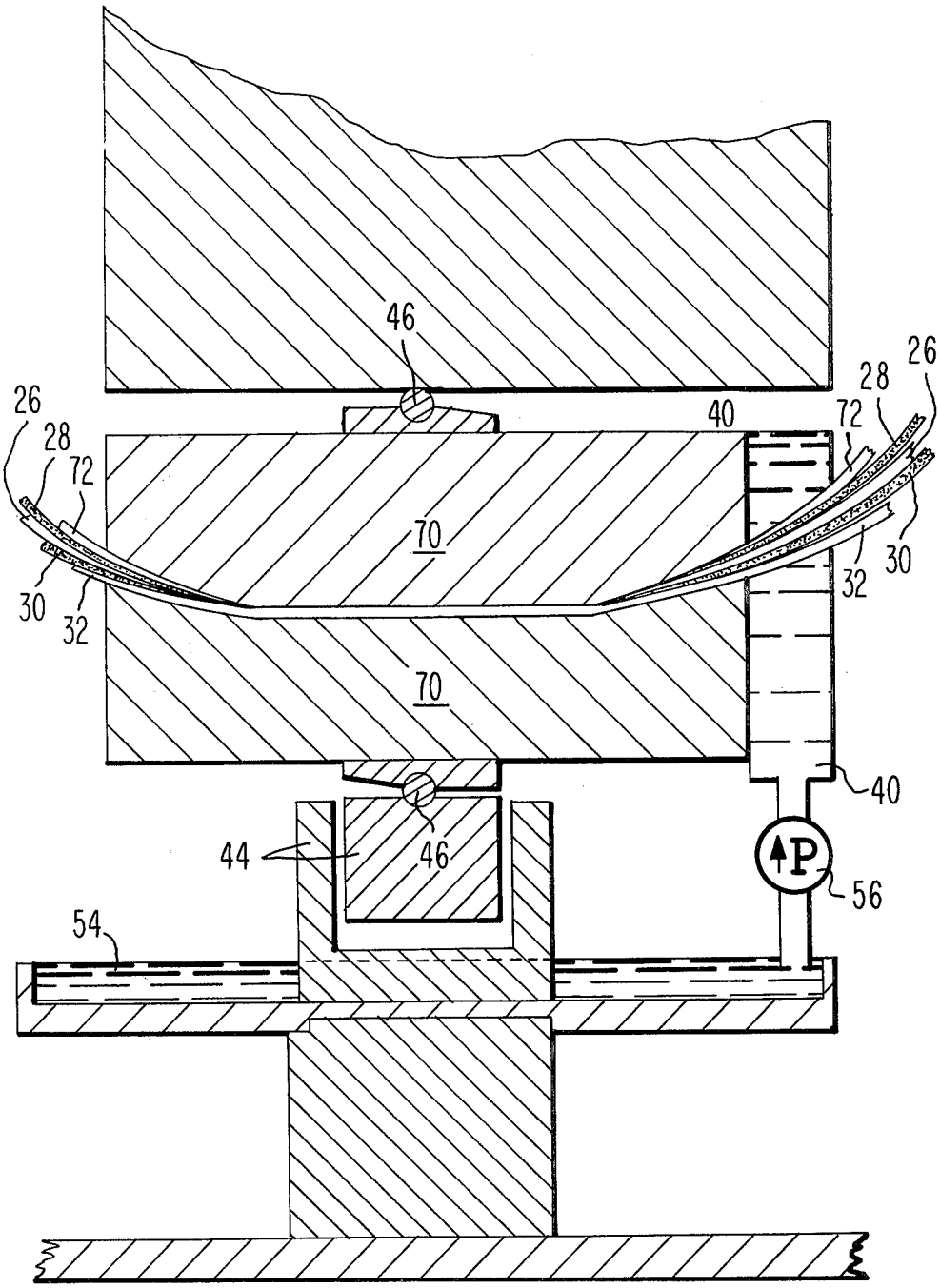
FIG. 7 is a sectional side view of two hydrodynamic shoes having the extended nip of the invention.

Alternative embodiments of the invention are shown in FIGS. 6 and 7. In FIG. 6, a hydrostatic shoe 60 is shown having hydrodynamic inrunning and outrunning nip surfaces 62 and 64, respectively. Hydrostatic shoe 60 exerts compressive forces on compliant belt 32 using lubricant in shoe reservoir 66 maintained under pressure by pump 68. In FIG. 7, two hydrodynamic shoes 70 are used to compress the compliant belt 32, lower felt 30, paper web 26, upper felt 28, and a second compliant belt 72. Reservoir 40 lubricate the interfaces of the compliant belts 32, 72 and hydrodynamic shoes 70.

The hydrodynamic inrunning nip surface 62 (FIGS. 6,7) has the length and inclination of the previously described nip shoe 24 (FIG. 5). Compliant belt 32 (FIGS. 6,7) contacts the lubricant in reservoir 40 to decrease the frictional force along the compliant belt-hydrodynamic inrunning nip surface. The compliant belt 32, lower felt 30, paper web 26, and upper felt 28 are then fully compressed from inrunning nip point 38 to outrunning nip point 50. Excess lubricant from reservoir 66 (FIG. 6) is channeled along hydrodynamic outrunning nip surface 64 to catch pan 54 for recirculation to shoe reservoir 66 and lubricant reservoir 40. Hydrodynamic outrunning nip surface 64 (FIGS. 6,7) is inclined as outrunning nip surface 52 (FIG. 3) to gradually release the compressive force applied by hydrostatic shoe 60 (FIG. 6) and hydrodynamic shoe 70 (FIG. 7).

What is claimed is:

1. In a papermaking machine using a compliant transport system to move a web of paper over a hydrodynamic ramp on a hydrostatic shoe, the hydrostatic shoe including:

an open fluid reservoir;

means for pressurizing the fluid in the reservoir to exert a force against an opposing surface to form a nip between the opposing surface and the pressurized fluid; and means for advancing the hydrostatic shoe to exert pressure on a compliant transport system passing between the hydrostatic shoe and the opposing surface with which the hydrostatic shoe forms a nip; the improvement comprises:

means for supplying lubricant to the interface of the hydrodynamic ramp and the compliant transport system; and ramp means for gradually subjecting the compliant transport system to the pressure exerted by the hydrostatic shoe, the ramp means comprising:

an inrunning nip surface extending approximately 1.5° from a line substantially tangent to a load arc, defined by the hydrostatic shoe against the nip forming surface, through a vertex of a wedge formed when the compliant transport system simultaneously contacts the hydrostatic shoe and the opposing surface with which the hydrostatic shoe forms a nip;

an outrunning nip surface extended approximately 1.5° from a line substantially tangent to the load arc, resulting from the hydrostatic shoe against the nip forming surface, through a vertex of a wedge formed when the compliant transport system ceases to simultaneously contact the hydrostatic shoe and the opposing surface with which the hydrostatic shoe forms a nip; and means for controllably distributing the release of the pressure exerted by the hydrostatic shoe on side edge portions of the compliant transport system.

2. The invention of claim 1, wherein the means for supplying lubricant to the interface of the hydrodynamic ramp and the compliant transport system comprises:

an open reservoir of lubricant;

means for raising the lubricant to a level sufficient to contact the entire width of the compliant transport system;

means for retaining a substantial amount of the lubricant in the reservoir during contact of the compliant transport system with the lubricant;

means for catching excess lubricant carried by the compliant transport system; and means for circulating caught lubricant to the reservoir.

3. The invention of claim 1, wherein said vertex of the wedge associated with the outrunning nip surface located on the hydrostatic shoe where the compliant transport system is compressed to a predetermined maximum between the hydrostatic shoe and the opposing surface with which the hydrostatic shoe forms a nip; and said vertex of the wedge associated with the outrunning nip surface located on the hydrostatic shoe where the compliant transport system ceases to be compressed to a predetermined maximum between the hydrostatic shoe and the opposing surface with which the hydrostatic shoe forms a nip.

4. The invention of claim 1 or 3, wherein the inrunning nip surface is extended approximately 2–4 inches at said angle of approximately 1.5° from the line substantially tangent to the load arc.

5. The invention of claim 1 or 3, wherein the means for controllably distributing the release of the pressure exerted by the hydrostatic shoe on side edge portions of the compliant transport system comprises edge surfaces inclined away from a line parallel to the plane of the surface with which the hydrostatic shoe forms a nip.

6. The invention of claim 1, wherein the hydrostatic shoe is pivotal about a point offset from a central axis of rotation for the shoe.

* * * * *

UNITED STATES PATENT AND TRADEMARK OFFICE

CERTIFICATE OF CORRECTION

PATENT NO. : 4,427,492

DATED : January 24, 1984

INVENTOR(S) : Dennis C. Cronin

It is certified that error appears in the above–identified patent and that said Letters Patent are hereby corrected as shown below:

Claim 3, 2nd & 3rd lines, change "outrunning" to --inrunning--.

Signed and Sealed this

*Eighth* Day of *May 1984*

[SEAL]

*Attest:*

GERALD J. MOSSINGHOFF

*Attesting Officer*

*Commissioner of Patents and Trademarks*